US005591089A

United States Patent [19]

Huffines

[11] Patent Number: 5,591,089

[45] Date of Patent: Jan. 7, 1997

[54] SWING TRAINER

[75] Inventor: Robert W. Huffines, Port St Lucie, Fla.

[73] Assignee: Gehr - Huff Technologies, Inc., West Palm Beach, Fla.

[21] Appl. No.: 541,372

[22] Filed: Oct. 10, 1995

Related U.S. Application Data

[63] Continuation-in-part of Ser. No. 379,268, Jan. 27, 1995, abandoned.

[51] Int. Cl.[6] ..... A63B 69/36

[52] U.S. Cl. ..... 473/215; 473/277; 446/28; 482/105; 273/DIG. 19

[58] Field of Search ..... 482/105; 473/211, 473/215, 277, 269, 270, 271; 273/DIG. 17, DIG. 19; 446/28

[56] References Cited

U.S. PATENT DOCUMENTS

| | | | |
|---|---|---|---|
| 1,513,773 | 11/1924 | Thompson | 273/58 F |
| 2,051,366 | 8/1936 | Catron | 482/10 |
| 3,200,536 | 8/1965 | Petitto | 273/DIG. 19 X |
| 3,410,554 | 11/1968 | Harrison | 446/26 X |
| 3,751,031 | 8/1973 | Yamauchi | 482/105 |
| 3,951,414 | 4/1976 | Nunez | 273/DIG. 17 X |
| 4,180,261 | 12/1979 | Kolka | 482/105 |
| 5,435,563 | 7/1995 | Salvatore | 473/215 |

*Primary Examiner*—George J. Marlo
*Attorney, Agent, or Firm*—Malin, Haley, DiMaggio & Crosby, P.A.

[57] ABSTRACT

An apparatus for use in training proper swing mechanics, for use in connection with golf, baseball, tennis, or similar sports. The device includes a sheath, which has an cushion member attached to a concave inner surface for user comfort. The apparatus is releasably attachable to a user's legs or hips by a pair of straps incorporating hook and loop fastening material, and includes a projecting rigid support member extending normal to the sheath outer surface with a weight member having a soft outer shell and suspended therefrom by a flexible cord; a clip device allows for adjustment of the cord length for suspending the weight member at a user selected position. The weight member includes access means for enabling user to add mass to, or subtract mass from, the suspended weight. The position and movement of the suspended weight member provides the user with feedback relative to numerous body positions and movements for teaching the user proper swing or body movement mechanics.

5 Claims, 10 Drawing Sheets

SWING TRAINER

This application is a continuation-in-part of U.S. application Ser. No. 08/379,268, filed Jan. 27, 1995 now abandoned.

BACKGROUND OF THE INVENTION

1. Field of the Invention

This invention relates generally to a swing training mechanism, and provides a training device for teaching proper swing mechanics for a variety of activities such as golf, baseball, or tennis. The device can be used in practice with respect to any activity in which body movements are important, and particularly those activities where the upper torso and lower body must move in coordination with one another, and in proper sequence, to achieve optimum results.

The device provides a feedback mechanism for teaching a user the proper sequential timing and body motions relating to various swinging motions. For example, the execution of a proper golf swing requires the legs, hips, shoulders, arms, and hands to move in proper sequence and rhythm during the swing while the golfer shifts body weight in a coordinated effort. Likewise, other activities, such as tennis, require similar coordinated movements. Thus, the present invention is directed to devices for providing positive feedback to a user for optimizing the motion and tempo associated with various swing movements.

2. Description of the Prior Art

A variety of devices are known in the prior art for assisting a user in developing proper swing mechanics for a number of sports. For example, U.S. Pat. No. 4,989,876 (Practice Golf Club and System), U.S. Pat. No. 4,909,515 (Golf Practice Club), U.S. Pat. No. 5,133,556 (Golf Trainer), and U.S. Pat. No. 4,957,295 (Head Movement Indicating Device and Method) disclose various mechanical devices and methods for monitoring and improving a golf swing. However, none of these devices have proven effective in the marketplace.

Accordingly, there still exists a need for a simple device capable of attachment to a variety of positions on a user for providing positive feedback of the user's movements.

SUMMARY OF THE INVENTION

The instant invention comprises a flexible, semi-rigid sheath which can be attached either to a user's leg or waist. The sheath includes a soft backing for comfort, as well as (in one embodiment), hook and loop attaching strips for tightly securing the unit upon a user. A cantilevered protruding member is connected to the sheath and extends normal to the sheath outer surface. The protruding member adjustably receives a cord having a weighted member connected thereon.

The present device is used to monitor proper swing mechanics and the sequence of body movements. In golf, for example, there are several important positions and movements that contribute to a striking the ball properly and achieving optimum trajectory and distance. In addition, a complete game of golf requires the golfer to execute various strokes such as the putt, the chip, the pitch, the full swing, and sand shots; each of which require distinct swing mechanics.

A golfer utilizing the instant invention attaches the device to his body in any one of several specific locations such that the weighted member hangs suspended above the golfers feet. Since gravity causes the suspended member to hang vertically, the instant invention is useful in determining the proper stance and weight balance. Thus, the weighted member should hang in specific locations relative to the golfer's body (i.e. the left foot when attached to the left thigh) thereby indicating that the golfer has distributed his weight properly and assumed a proper stance.

Furthermore, when the golfer executes one of the various strokes, and the associated body movement acts on the suspended weighted member. The resulting motion (or lack of motion) of the suspended weighted member indicates body movement and hence provides positive feedback to the user. Since certain golf strokes mandate that certain parts of the body remain still, while other golf strokes require body movement in a particular direction, the swinging motion of the instant invention is useful in developing proper swing mechanics.

In accordance with these and other objects which will become apparent hereinafter, the instant invention will now be described with particular reference to the accompanying drawings.

BRIEF DESCRIPTION OF THE DRAWINGS

FIG. 10 is a perspective View of the golfer at mid follow-through.

FIG. 11 is a perspective view of the golfer at full follow-through.

FIG. 14 is a perspective view of the golfer in a pitch shot follow-through.

DESCRIPTION OF THE PREFERRED EMBODIMENT

Figures 1, 2:
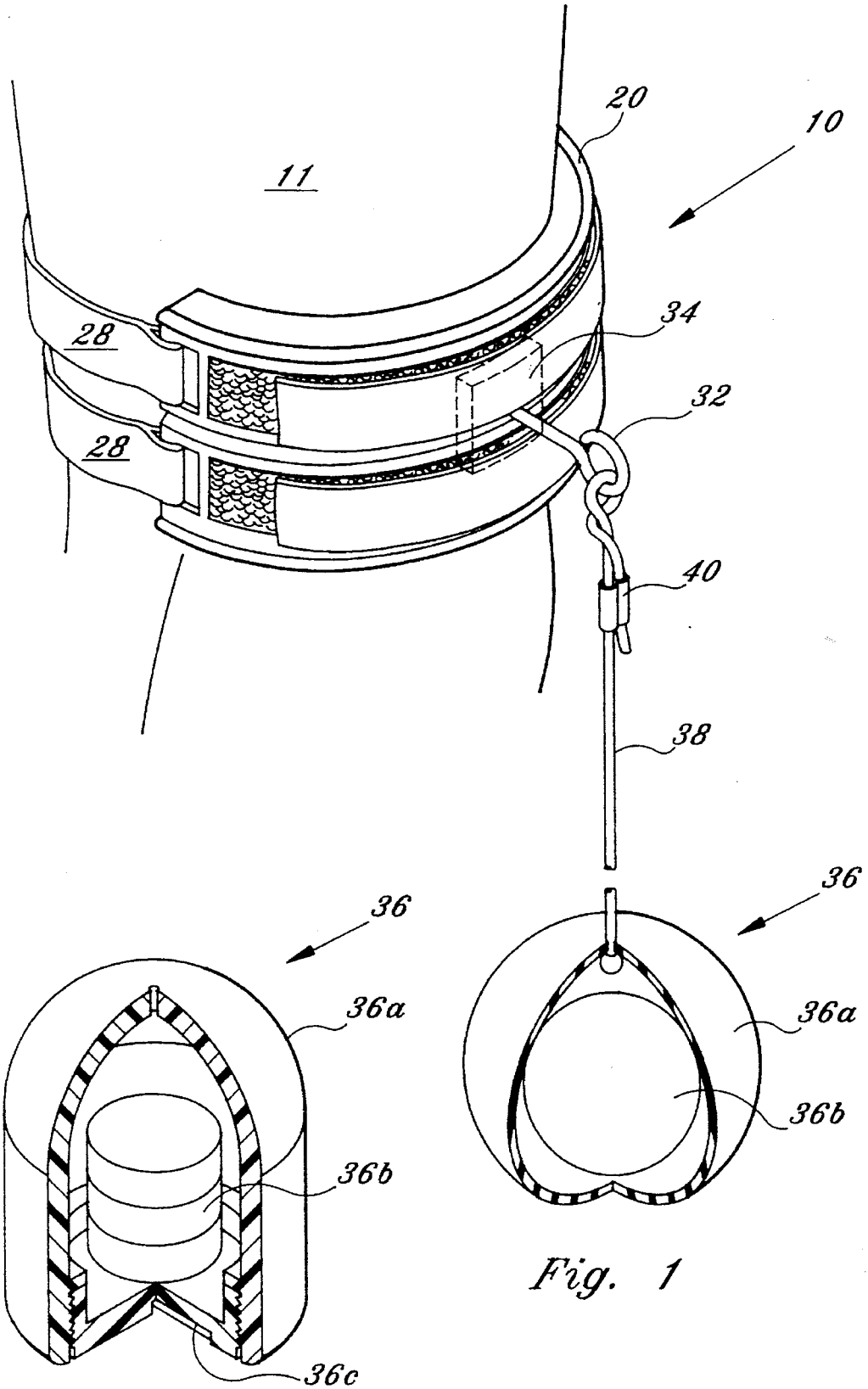
FIG. 1 is a perspective view in partial section of the present invention secured to a user's leg.
FIG. 2 is a perspective sectional view of an alternate embodiment of the hanging weighted member.

As best depicted in FIGS. 1–4, the instant invention, generally designated 10, is shown attached to a user's leg 11 in FIG. 1. The invention comprises a unit 10 including a flexible, yet semi-rigid, sheath means 20 which can be attached either to a user's leg 11 or about the user's waist (not shown). Sheath 20 is substantially C-shaped for conforming to the user's leg as depicted in FIG. 1, or for conforming to the user's left or right side at the waist as previously disclosed.

Sheath 20 may be fabricated from any suitable material, and any shape that allows for suitable attachment to a user is within the scope of the invention. Sheath 20 includes an inner surface 22 an outer surface 24 and may include an interface means 26 providing a soft backing material connected to inner surface 22 for user comfort and cushioning.

Figure 3:
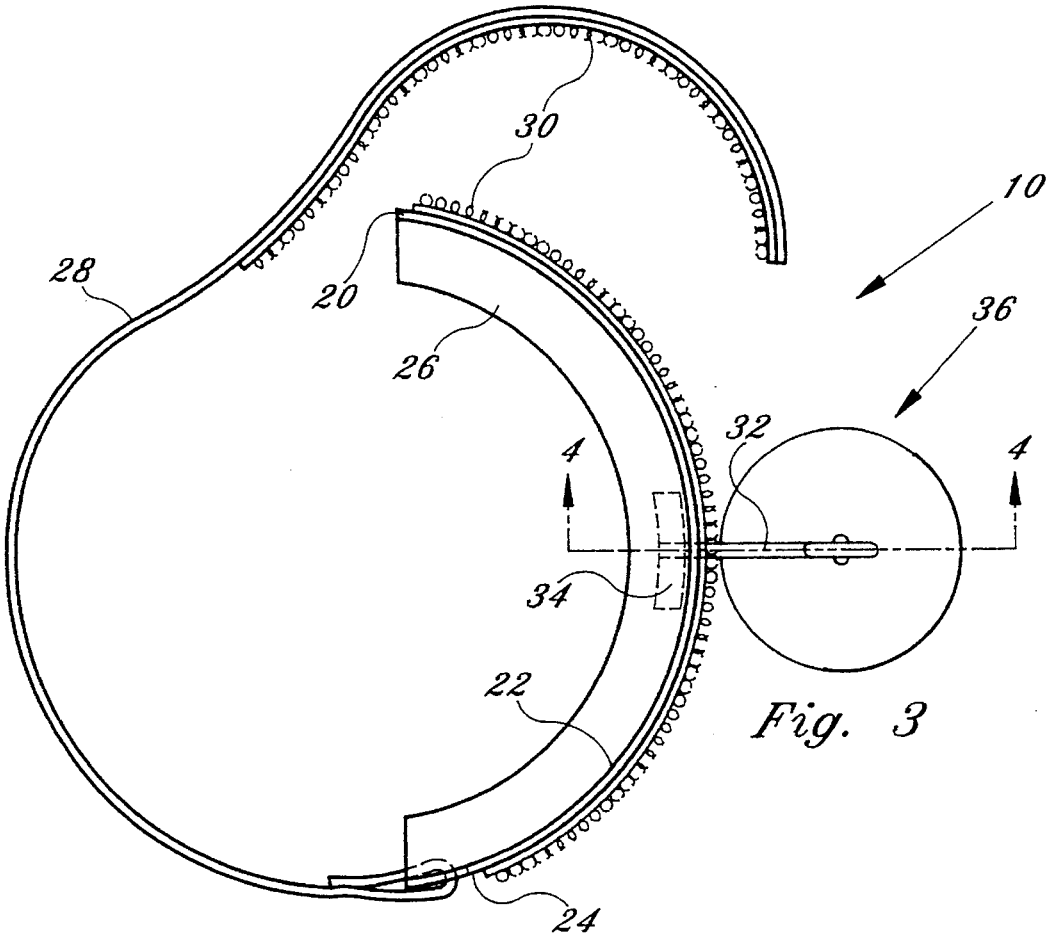
FIG. 3 is a top view of the present invention.
Figure 4:
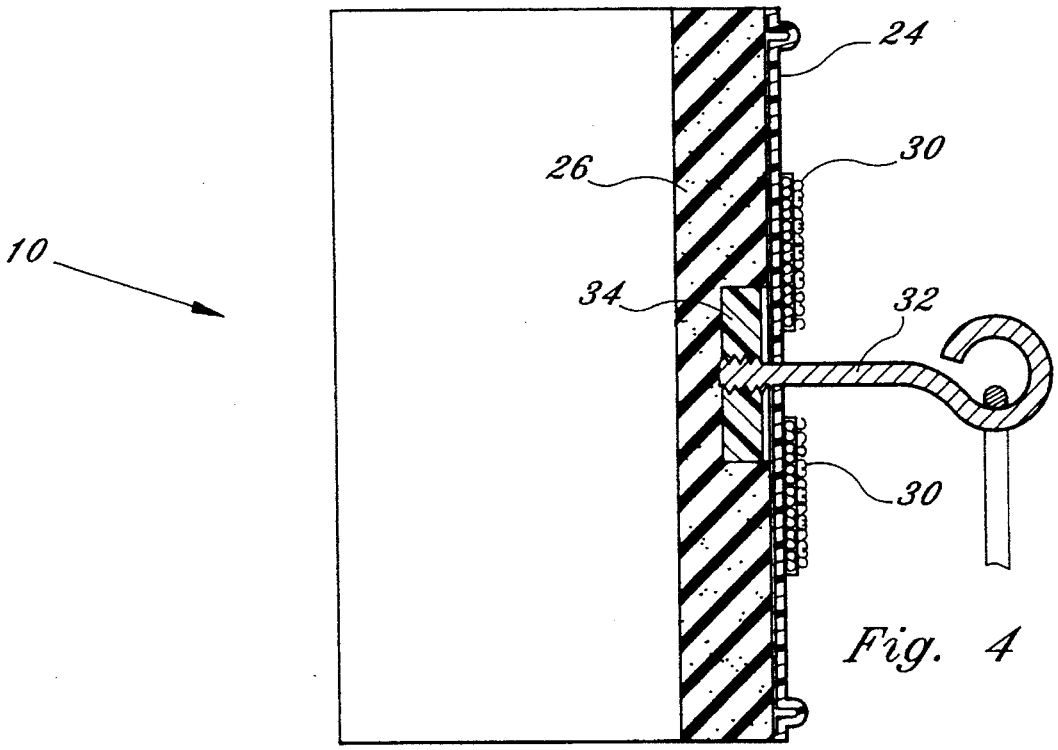
FIG. 4 is a longitudinal sectional view taken along section line 4 in FIG. 3.

In addition, sheath 20 includes a means for securing the unit upon a user. In a preferred embodiment, as depicted in FIGS. 1 and 3, the means for securing the unit upon a user includes one or more straps 28, each connected at one end to a portion of the sheath for tightly securing the unit upon a user. Straps 28 each include a means for fastening a strap end portion to sheath 20. In a preferred embodiment, the means for fastening comprises hook and loop attaching strips 30 connected for mating engagement to straps 28, and the sheath outer surface 24, as best depicted in FIG. 3.

Sheath 20 further includes a rigid protruding support member 32 having first and second ends. The first support member end is fixed to a rigid plate 34 embedded within the sheath such that support member 32 is cantilevered, projecting normal to outer sheath surface 24. The means of fixation may allow for quick and easy replacement of one support member having a fixed length, with a second support member comprising a different length.

A weight means comprising a weighted hanging member 36 is adjustably suspended from the second support member end by an adjustable suspension means comprising a cord 38. In other embodiments it may be desirable to have the weight means adjustably suspended directly from sheath 20. Cord 38 includes a means for adjusting the cord length 40 such that weighted member 36 may be suspended at various user selected positions for reasons which will soon become apparent. In FIG. 1, the means for adjusting cord length is shown as a clip 40 for allowing adjustment of the cord length; however, any suitable adjusting device or method is considered within the scope of the invention.

In the preferred embodiment, weight means 36 comprises a hanging member including a soft outer shell **36*a* housing a weight mass 36*b*. Soft outer shell 36*a* provides cushioning to prevent hanging member from bruising or otherwise harming the user should hanging member 36 impact upon the user's body during use. Outer shell 36*a* may have any suitable shape. Hanging member 36 may also include a means for adding and/or removing weight mass. In the preferred embodiment, the means for adding weight mass comprises an access component 36*c* removably mounted to a portion of shell 36*a*. In FIG. 2, access component 36*c* is shown in threaded engagement with shell 36*a* such access component 36*c* may be easily removed for adding to, or subtracting from, weight mass 36*b***.

Figure 5:
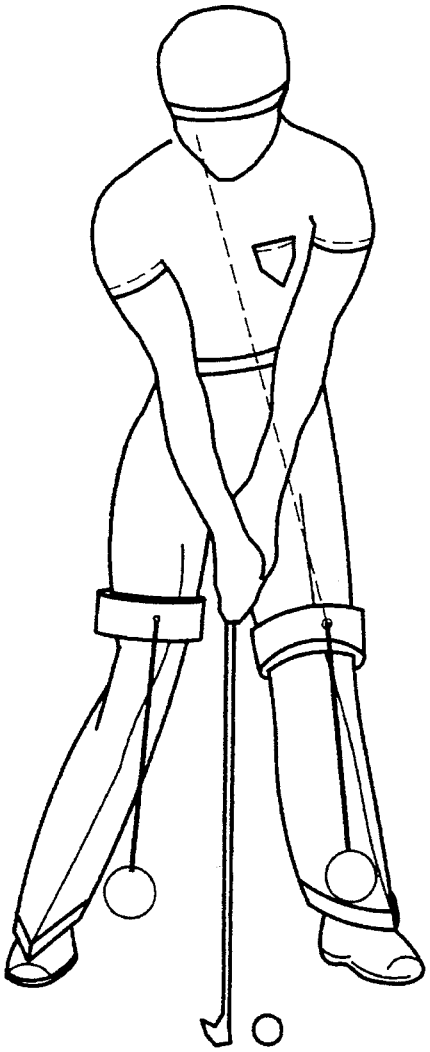
FIG. 5 is a perspective view of a golfer in set-up stance having swing trainers on each leg.

Accordingly, the unit may be securely attached to a user's leg by placing the sheath inner surface adjacent to the user's thigh such that soft backing material 26 is disposed between the user's leg and sheath 20, and the rigid protruding member extends in front of the user, and normal to the sheath outer surface. Straps 28 are then wrapped around the user's leg and secured to the sheath with the use of hook and loop material in a conventional manner thereby securing the sheath upon the user. When properly secured to the user's leg the hanging member 36 is suspended above or substantially adjacent to the user's foot as best depicted in FIG. 5.

ALTERNATE EMBODIMENT

Figure 1A:
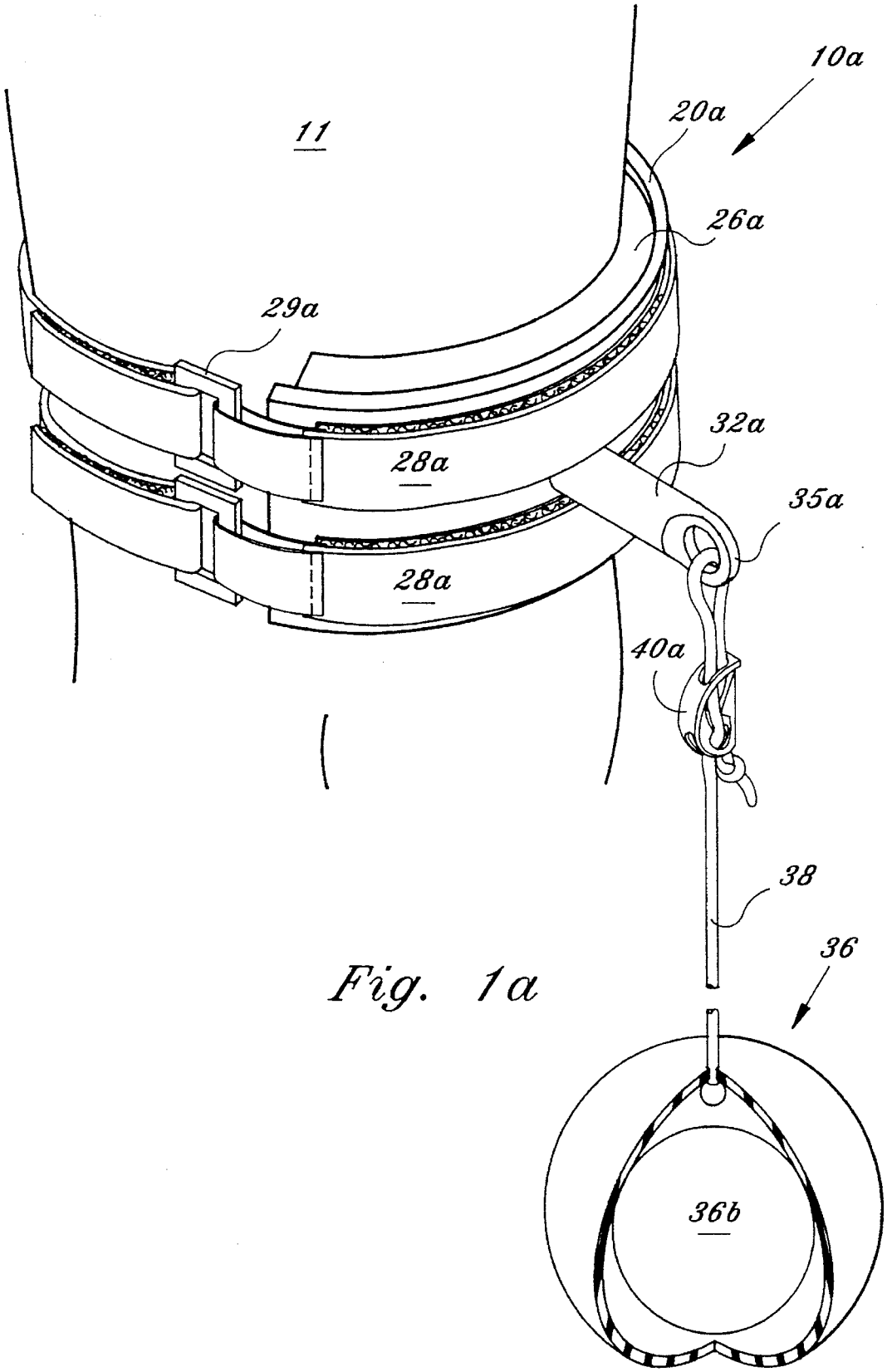
FIG. 1*a* is a perspective view in partial section of an alternate embodiment of the present invention secured to a user's leg.

An alternate embodiment is depicted in FIGS. **1*a*, 3*a* and 4*a*. In FIG. 1*a*, the alternate embodiment, generally designated 10*a*, is shown attached to a user's leg 11. The alternate embodiment comprises a unit 10*a* including a semi-flexible, sheath means 20*a* which can be attached either to a user's leg 11 or about the user's waist (not shown). Sheath 20*a* is semi-circular for conforming to the user's leg as depicted in FIG. 1*a***, or for conforming to the user's left or right side at the waist (not shown).

In the alternate embodiment, sheath **20*a* may be fabricated from any suitable material, and any shape that allows for suitable attachment to a user is within the scope of the invention. Sheath 20*a* includes an inner surface 22*a* an outer surface 24*a* and may include an interface means 26*a*, connected to inner surface 22*a***, for providing a soft backing material to provide user comfort and cushioning.

Figure 3A:
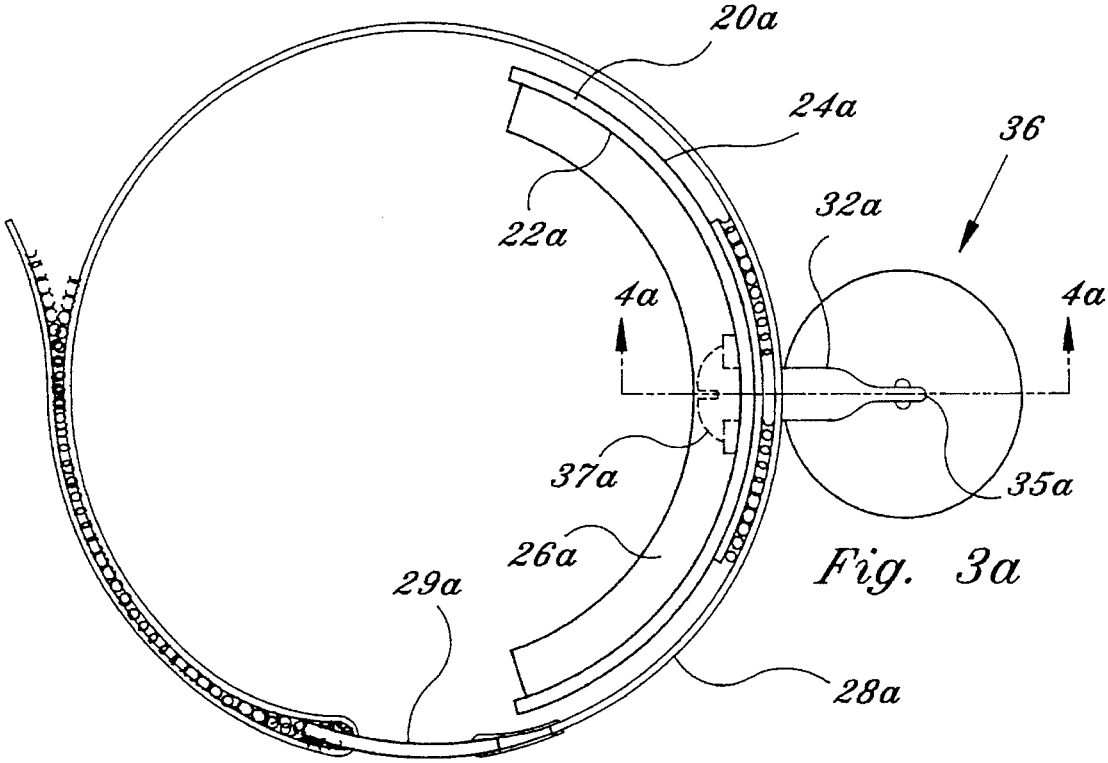
FIG. 3*a* is a top view of an alternate embodiment of the present invention.
Figure 4A:
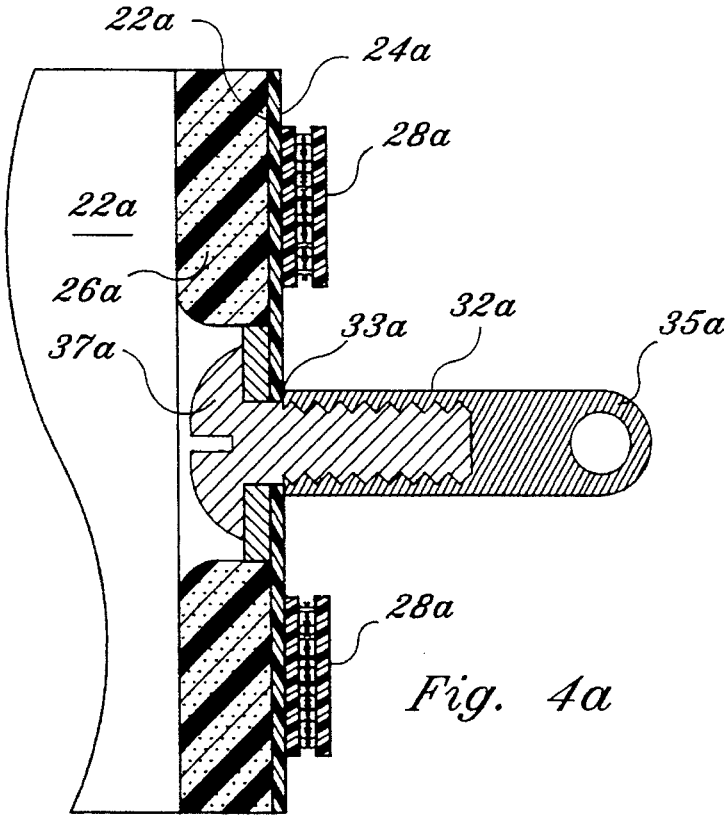
FIG. 4*a* is a longitudinal sectional view taken along section line 4*a* in FIG. 3.

In addition, sheath **20*a* also includes a means for securing the unit upon a user. In the alternate embodiment the means for securing the unit upon a user includes one or more straps 28*a*. In the alternate embodiment straps 28*a* and sheath outer surface 24*a* each incorporate hook and loop fastening material such that straps 28*a* may be secured to sheath outer surface 24*a* for tightly securing the unit upon a user, as best depicted in FIGS. 1*a*, 3*a*, and 4*a*. Straps 28*a* each include a an end portion having a rigid loop 29*a* through which a second strap end portion, having hook and loop fastening material thereon is inserted and doubled back for mating engagement whereby the second strap end is secured as depicted in FIG. 3*a***.

In a preferred embodiment, the means for fastening the straps to the sheath comprises hook and loop attaching strips **30*a* connected for mating engagement to straps 28*a*, and the sheath outer surface 24*a*, as best depicted in FIG. 3*a***.

Sheath **20*a* further includes a rigid protruding support member 32*a* having a first end 33*a* defining a threaded aperture and a second end 35*a* defining a mounting aperture for supporting cord 38*a*. The first end 33*a* is fixed to sheath 20*a* with a fastening means comprising a threaded fastener 37*a*, and associated washer, embedded within the sheath such that support member 32*a* is cantilevered, projecting normal to outer surface 24*a***.

The alternate embodiment also incorporates a weight means comprising a weighted hanging member 36 adjustably suspended from the second support member end by an adjustable suspension means comprising a cord 38. In other embodiments it may be desirable to have the weight means adjustably suspended directly from sheath 20. Cord 38 includes a means for adjusting the cord length such that weighted member 36 may be suspended at various user selected positions for reasons which will soon become apparent. In FIG. **1*a*, the means for adjusting cord length is shown as a clip 40*a*** for allowing adjustment of the cord length; however, any suitable adjusting device or method is considered within the scope of the invention.

Either embodiment of the instant invention may be used as a swing training mechanism for teaching proper swing mechanics for a variety of activities. For example, with respect to the game of golf, the invention may be used in enabling a user to execute a proper golf swing which requires coordinated movement of the legs, hips, shoulders and arms.

Figure 6:
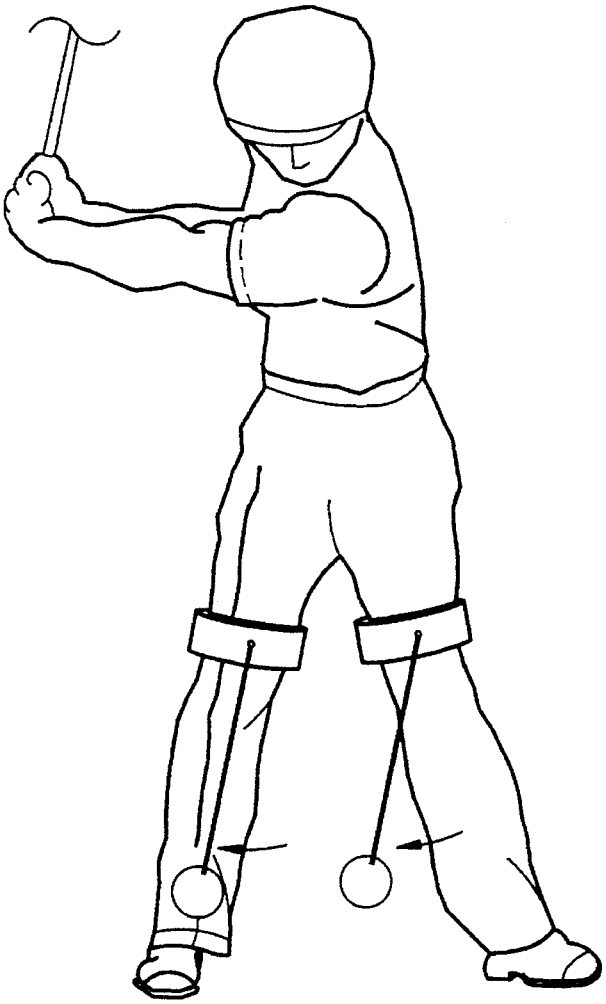
FIG. 6 is a perspective view of the golfer in mid backswing.
Figure 7:
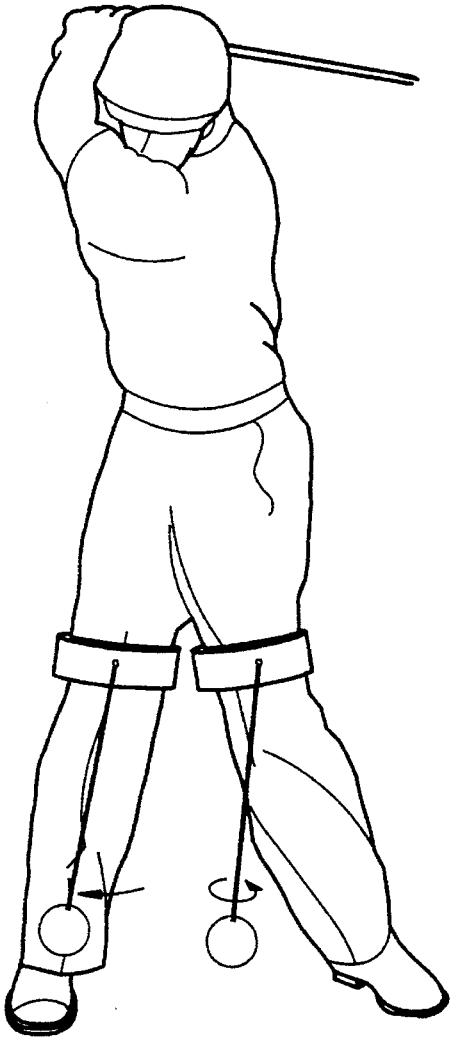
FIG. 7 is a perspective view of the golfer at the top of his backswing.
Figure 8:
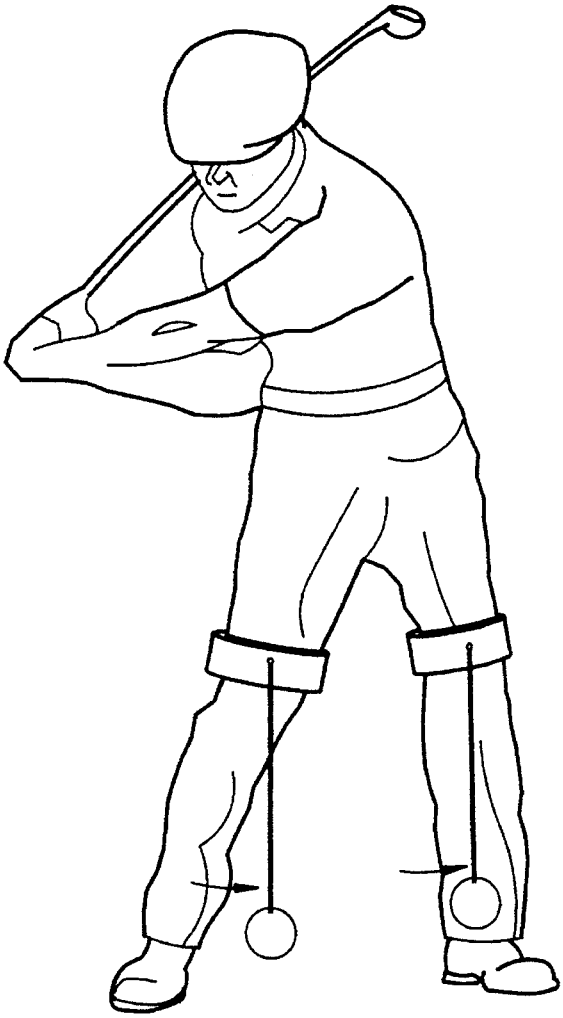
FIG. 8 is a perspective view of the golfer in mid downswing.
Figure 9:
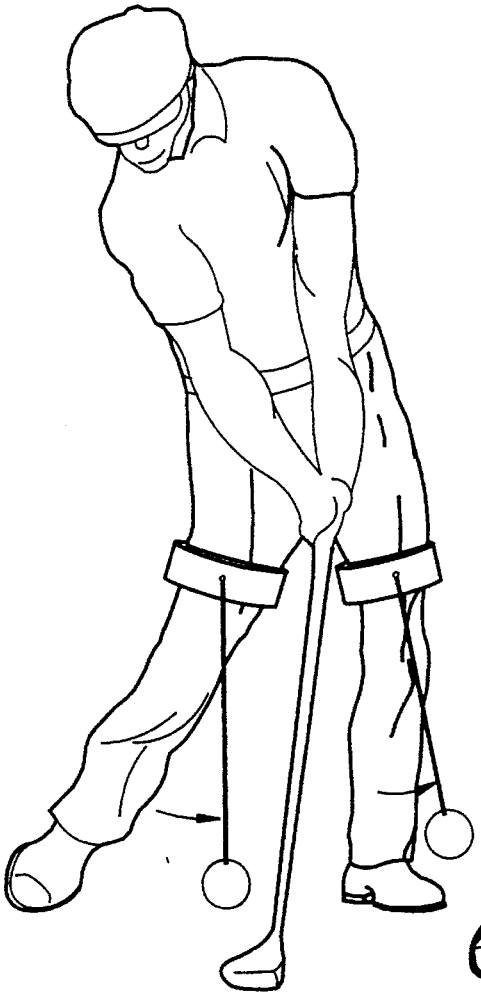
FIG. 9 is a perspective view of the golfer at impact.
Figure 10:
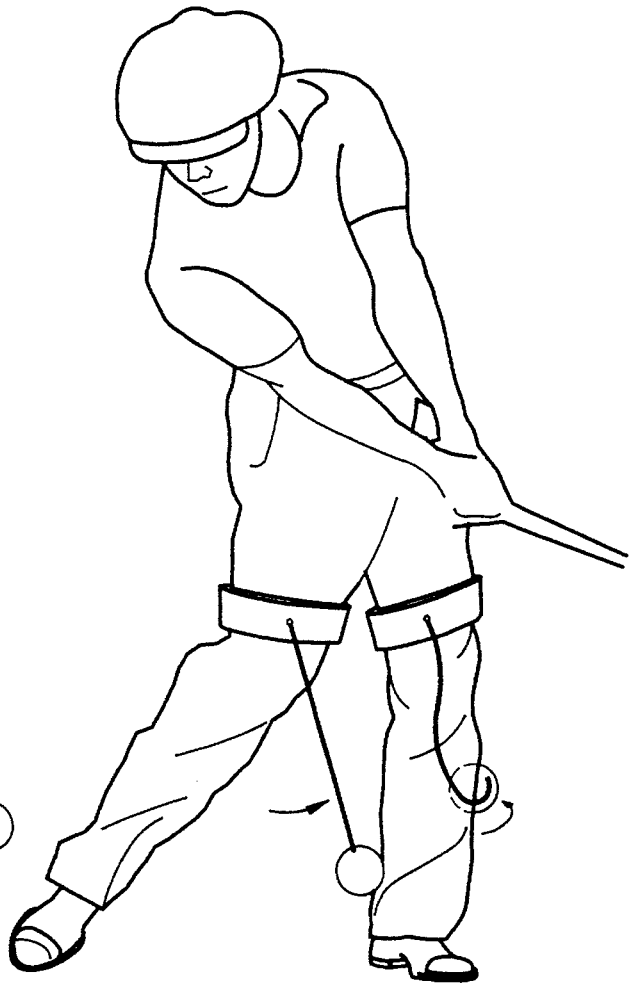
Figure 11:
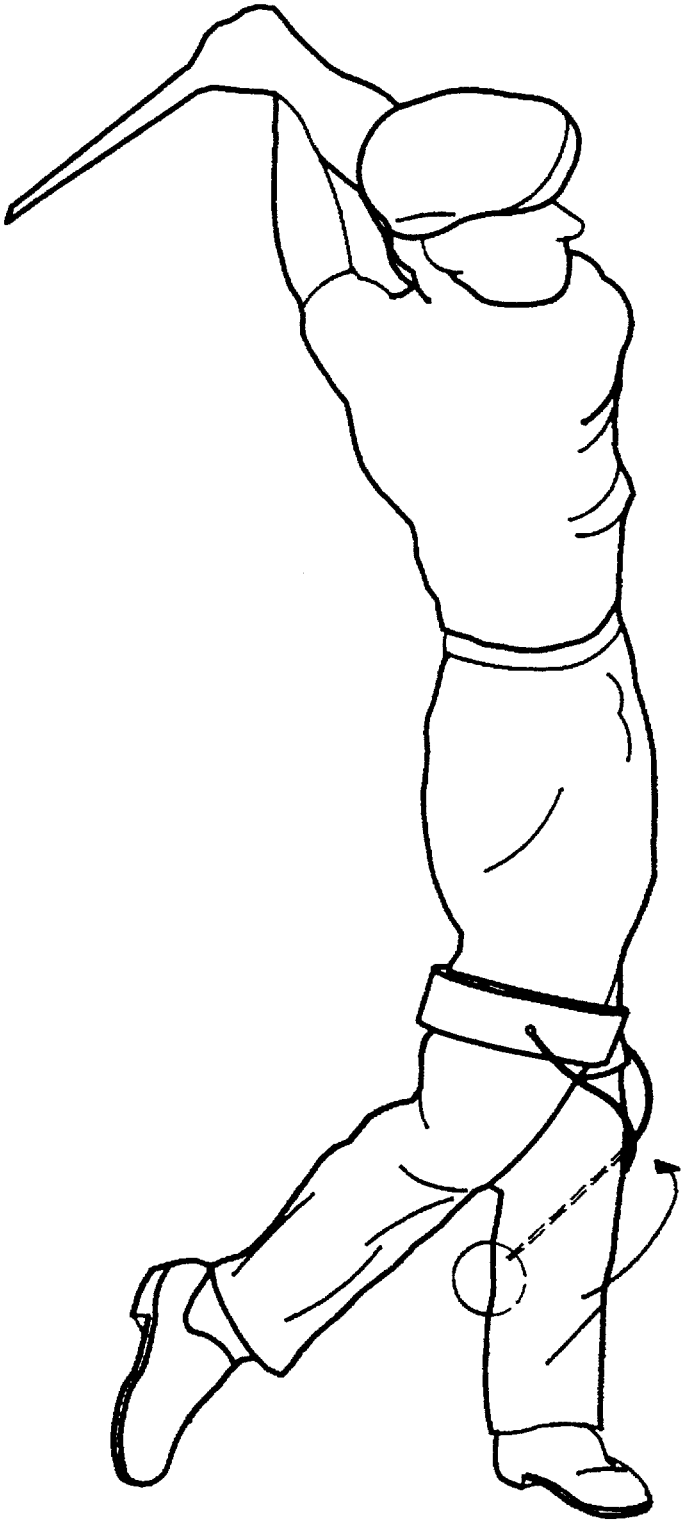
Figure 12:
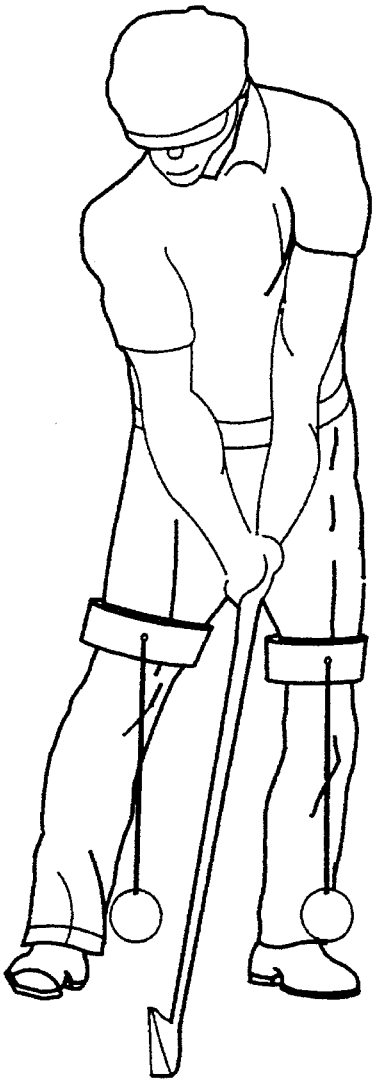
FIG. 12 is a perspective view of a golfer in a pitch shot set-up stance.
Figure 13:
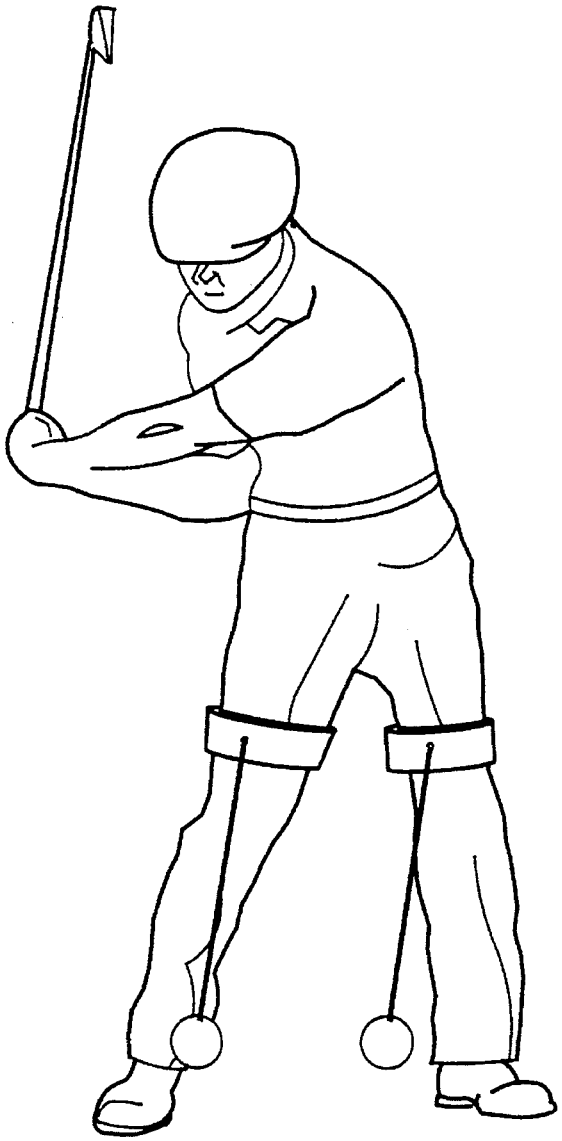
FIG. 13 is a perspective view of the golfer in a full pitch shot backswing.
Figure 14:
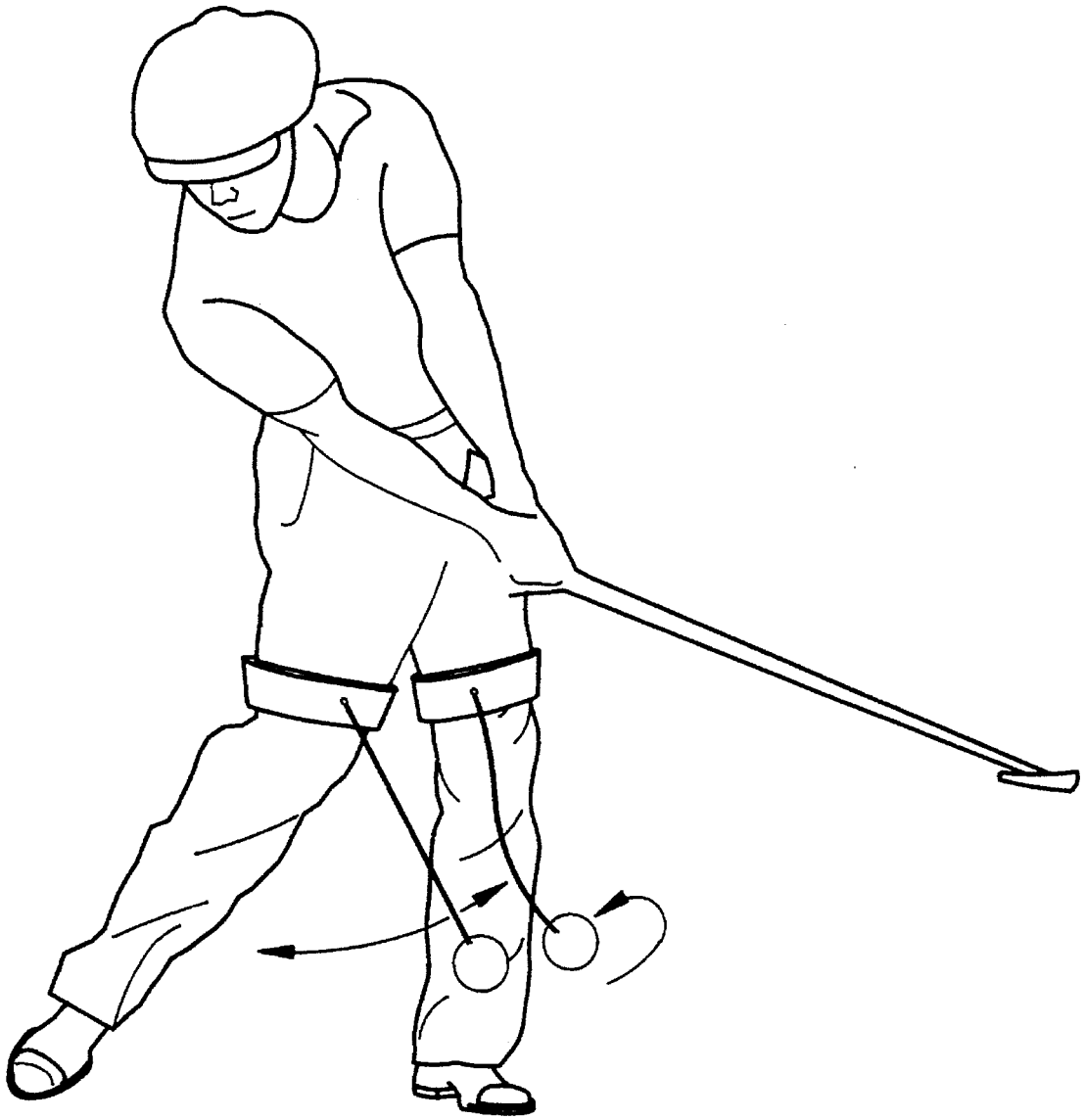

When attached to a golfer's left leg as depicted in FIG. 5, the position of hanging member 36 assists the golfer in attaining the proper stance. Hanging member 36 indicates when the golfer is in a proper stance by the suspended positioning of member 36 slightly inside of the left leg. Proper movement of the golfer's lower body during the backswing results in member 36 moving to a suspended position substantially aligned with the center of the golfer's stance as depicted in FIGS. 6 and 7. Proper movement of the golfer's lower body during the downswing and follow through results in member 36 swinging around the outside of the golfer's left calf as depicted in FIGS. 8–10.

When attached to a golfer's right leg as depicted in FIG. 5, hanging member 36 indicates when the golfer is in a proper stance by the suspended positioning of member 36 slightly inside of the right leg. Proper movement of the golfer's lower body during the backswing results in member 36 moving to a suspended position directly over the right foot as depicted in FIGS. 6 and 7. Proper movement of the golfer's lower body during the downswing and follow through results in member 36 swinging around the outside of the golfer's left calf as depicted in FIGS. 8–10.

In a similar manner the instant invention may be attached to the golfer's right or left hip (not shown). In this mode of use, hanging member indicates when the golfer is in a proper stance by the positioning of member 36 centered on the golfer's right or left leg near the knee. Likewise, the user may attach the instant invention to any suitable part of the body such that the position of the hanging member functions to provide feedback to the user relative to the user's stance and/or weight distribution. For example, when attached to the user's shoulder (not shown) a correct golfing posture is indicated by the suspended positioning of the hanging member over the balls of the user's feet. As is now apparent, the instant device may be utilized in any manner suitable for providing feedback relative to the user's stance, posture, and weight distribution.

The invention also teaches proper hip turn during a golf swing when mounted on the hip. When attached to the right hip, member 36 will hang behind the golfer at the completion of the backswing, and, with the proper turn on the down swing and follow through, will swing around the golfer and wrap around the left thigh; if the hip turn is blocked, member 36 will not swing full to the left side and will return back toward the golfer's right leg. When attached to the left hip, the proper follow through turn results in the member 36 wrapping around the back of the right thigh.

The instant invention may also be used to teach proper putting mechanics with the invention attached to either the left or right thigh. When putting, it is important that the golfer's lower body remain steady during the putt back stroke and follow through. Accordingly, any undesirable lower body sway during the putting stroke causes member 36 to swing thereby indicating unwanted movement.

Likewise, the instant invention is useful in teaching proper golf chip shot swing mechanics. A proper chip shot requires the golfer to place most of his weight on his left leg. As a result, the golfer appears to lean toward the target or down the target line. Accordingly, when the instant invention is attached to the golfer's right leg, a proper stance is indicated by member 36 being positioned above the center of the golfer's stance. With the invention attached to the golfer's left leg, a proper stance is indicated by member 36 being positioned outside of the left foot. Execution of a proper chip shot requires that the lower body remain steady during the backswing. Therefore, hanging member 36 should remain relatively steady through the completion of the golfer's backswing; the golfer is alerted to undesirable lower body movement, if, after completion of the backswing, hanging member 36 is swinging. The present invention is useful in teaching proper body movements associated with the downswing and follow-through. With the present invention attached to the right leg, the proper follow-through causes hanging member to swing down the target line. With the invention attached to the left leg, the proper follow-through and associated hip turn, cause hanging member to swing perpendicular to the target line.

Likewise, the instant invention is useful in teaching proper golf pitch shot swing mechanics. As with the chip shot, a proper pitch shot requires the golfer to place his weight substantially on his left leg. The golfer again appears to lean toward the target or down the target line, however, the degree of body lean is less pronounced. Accordingly, when the instant invention is attached to the golfer's right leg, a proper stance is indicated by member 36 being positioned above the inside of the right foot. With the invention attached to the golfer's left leg, a proper stance is indicated by member 36 being positioned outside of the left foot. Execution of a proper pitch shot requires more lower body turn, during the backswing, than does the chip shot. Therefore, hanging member 36 should move slightly to a position directly above the right foot, when the invention is attached to the golfer's right leg, at the completion of the golfer's backswing. When attached to the left leg, hanging member will move to a position above the center of the golfer's stance at the completion of the backswing. The present invention again is useful in teaching proper body movements associated with the pitch shot downswing and follow-through. With the present invention attached to the right leg, the proper follow-through causes hanging member to swing down the target line and around behind the user impacting the back of the left calf; insufficient hip turn will cause hanging member 36 to simply swing back and forth along the target line. With the invention attached to the left leg, the proper pitch shot follow-through and associated hip turn, causes hanging member to swing out and impact the golfer's left calf.

While a detailed explanation has been provided for the use of the present invention in connection with teaching proper golf swing mechanics, it is specifically noted that the invention is equally useful in any sport where coordinated body movement is required, and, thus, the present invention should not be interpreted as being limited to the sport of golf.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An apparatus for training a user in proper swing mechanics, for use with respect to the games of golf, baseball, tennis, or similar sports, comprising:

a semi-circular, flexible sheath, said sheath having an outer surface, a concave inner surface, a top end a bottom end, and first and second sides;

means for releasably securing said sheath to a portion of the user's body;

an elongated rigid support member extending normal to said sheath outer surface, said support member terminating in a supporting end defining an aperture therein;

a flexible cord, having an upper end connected to said supporting end, and a lower end; and, a weight means including a soft outer shell, said shell connected to said cord lower end, whereby said weight means is freely suspended by said flexible cord from said support member such that the user's body movements cause movement of said weight means, which movement provides positive feedback to the user for assisting the user in executing proper swing mechanics.

2. An apparatus according to claim 1, wherein said outer shell further includes an access means for providing access for allowing the user to adjust the mass of said weight means.

3. An apparatus according to claim 1, further including a means for adjusting the effective length of said cord.

4. An apparatus according to claim 3, wherein said means for adjusting comprises a clip.

5. An apparatus for training a user in proper swing mechanics, for use with respect to the games of golf, baseball, tennis, or similar sports, comprising:

an arcuate semi-rigid sheath member adapted to be secured around the user's thigh, waist, or shoulder said sheath member having a concave inner surface, upper and lower ends and first and second sides;

an interface means connected to said sheath inner surface, said interface means providing a soft backing for user comfort and cushioning;

a pair of straps attached to said sheath member, one of said pair of straps attached proximate said sheath member upper end and the other strap attached proximate said sheath lower end, each of said straps including a first end having a rigid loop fixed thereto and a second end portion having hook and loop fastening material attached thereto;

an elongate rigid support member having a first end connected to said sheath member and generally centrally disposed between said upper and lower ends and said first and second sheath sides, said support member projecting normal to said sheath outer surface, said support member having a second end defining a mounting aperture;

a flexible cord threaded through said mounting aperture and adjustably secured by a clip device;

a hanging member suspended from said support member second end by said cord, said hanging member comprising a soft outer shell housing at least one weight mass, and means for accessing said weight mass for adding weight thereto and subtracting weight therefrom; and said clip device enabling the user to adjust the effective length of said cord thereby adjusting the suspended position of said hanging member relative to said support member.

* * * * *